US007241350B2

(12) United States Patent
Rosenthul

(10) Patent No.: US 7,241,350 B2
(45) Date of Patent: Jul. 10, 2007

(54) CORROSION RESISTANT POLY-METAL DIFFUSION COATINGS AND A METHOD OF APPLYING SAME

(75) Inventor: Itzhak Rosenthul, Kedumim (IL)

(73) Assignee: Greenkote (Israel) Ltd., Barkan Industrial Area (IL)

( * ) Notice: Subject to any disclaimer, the term of this patent is extended or adjusted under 35 U.S.C. 154(b) by 0 days.

(21) Appl. No.: 10/308,988

(22) Filed: Dec. 3, 2002

(65) Prior Publication Data

US 2004/0105998 A1 Jun. 3, 2004

(51) Int. Cl.
*B32B 15/01* (2006.01)
*C23C 2/00* (2006.01)

(52) U.S. Cl. ..... 148/533; 148/527; 148/529; 427/321; 427/433; 428/659

(58) Field of Classification Search ..... 148/240, 148/279, 280, 276, 527, 529, 533; 428/472.2, 428/659; 427/321, 433
See application file for complete search history.

(56) References Cited

U.S. PATENT DOCUMENTS 3,808,031 A * 4/1974 Brill-Edwards ..... 427/252
4,401,727 A * 8/1983 Berke et al. ..... 428/610
6,171,359 B1 1/2001 Levinski et al.

FOREIGN PATENT DOCUMENTS

| | | | |
|---|---|---|---|
| BE | 897788 A | * | 1/1984 |
| CA | 0970116 A2 | | 7/1975 |
| DE | 4238220 C1 | | 5/1993 |
| EP | 119180 B | * | 3/1989 |
| EP | 0968066 A1 | | 1/2000 |
| WO | WO 9841346 A1 | | 9/1998 |

* cited by examiner

*Primary Examiner*—Roy King
*Assistant Examiner*—Lois Zheng
(74) *Attorney, Agent, or Firm*—Edward Langer; Shiboleth Israeli Roberts Zisman & Co.

(57) ABSTRACT

Diffusion metallic anticorrosive zinc-iron-aluminum coatings of iron and iron-based item surfaces, realized by heating of products at temperatures of 370–450° C. in a saturating powder mixture environment in a closed container. The coating compositions are multiphase-polymetallic, and comprise zinc, iron and aluminum. Other elements may be added to attain specific coating properties. This coating exhibits a high corrosion resistance (at least a 700-hour corrosion resistance level in a standard salt spray test), a relatively high hardness level and good adhesion to secondary coatings.

15 Claims, 3 Drawing Sheets

Cross section of Al-Fe- Zn inclusion.

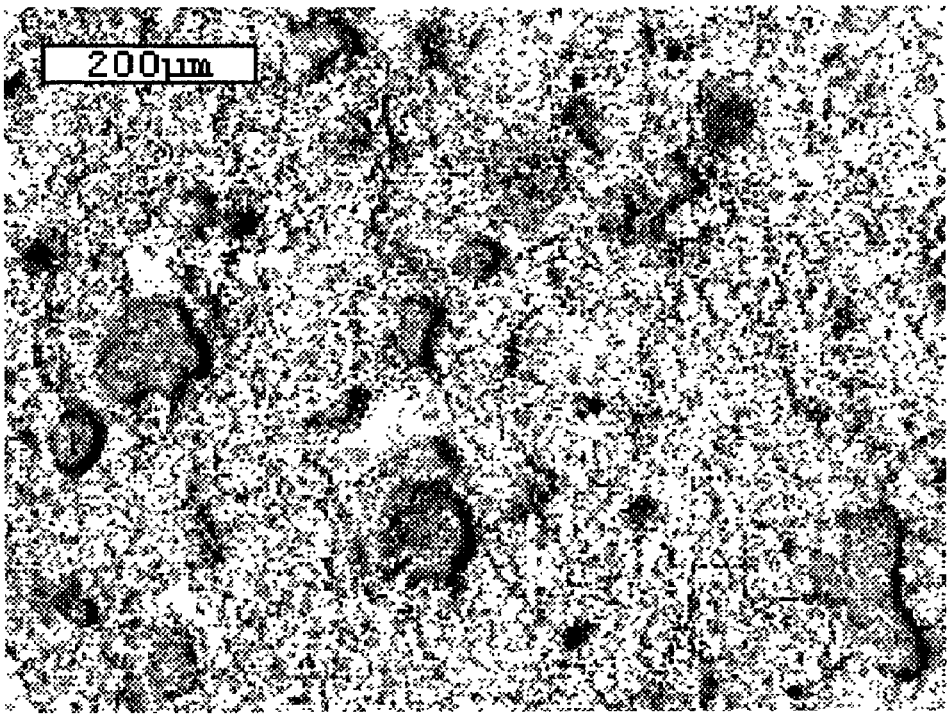
Fig. 1. Al-Fe- Zn inclusions on coating surface.
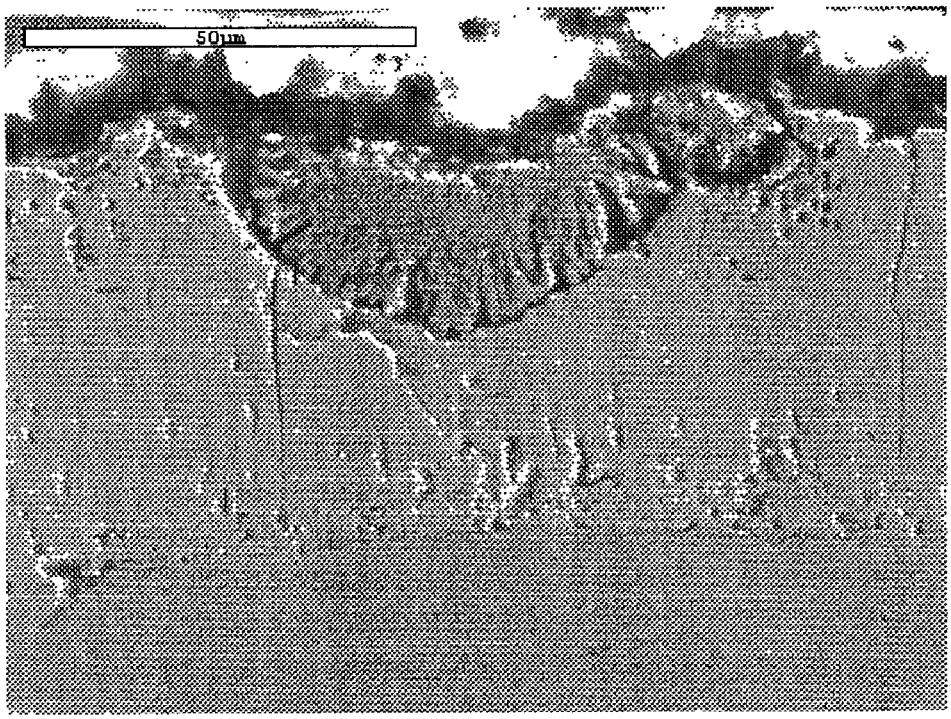
Fig. 2. Cross section of Al-Fe- Zn inclusion.

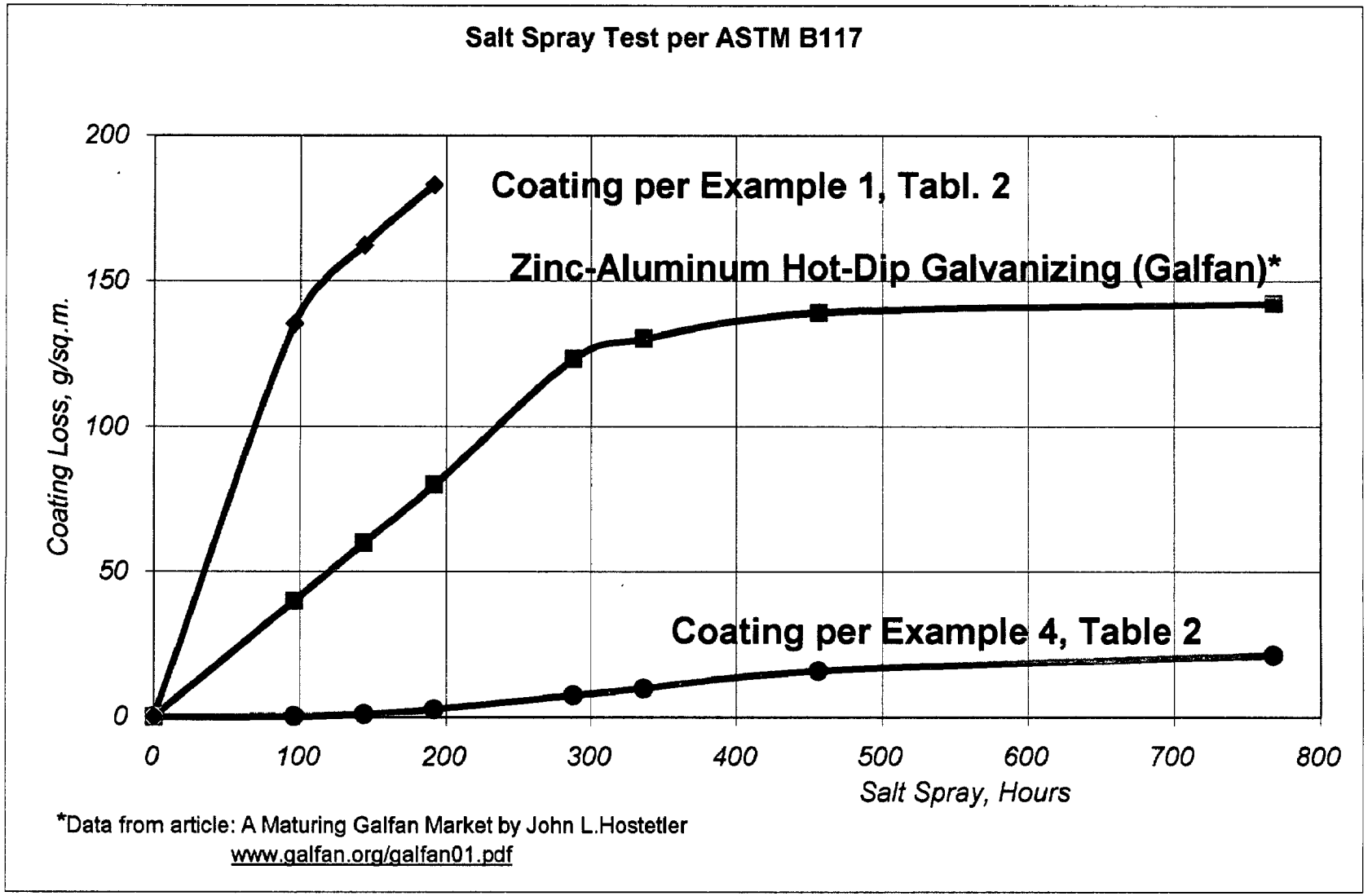
Fig. 3. Salt Spray test results.

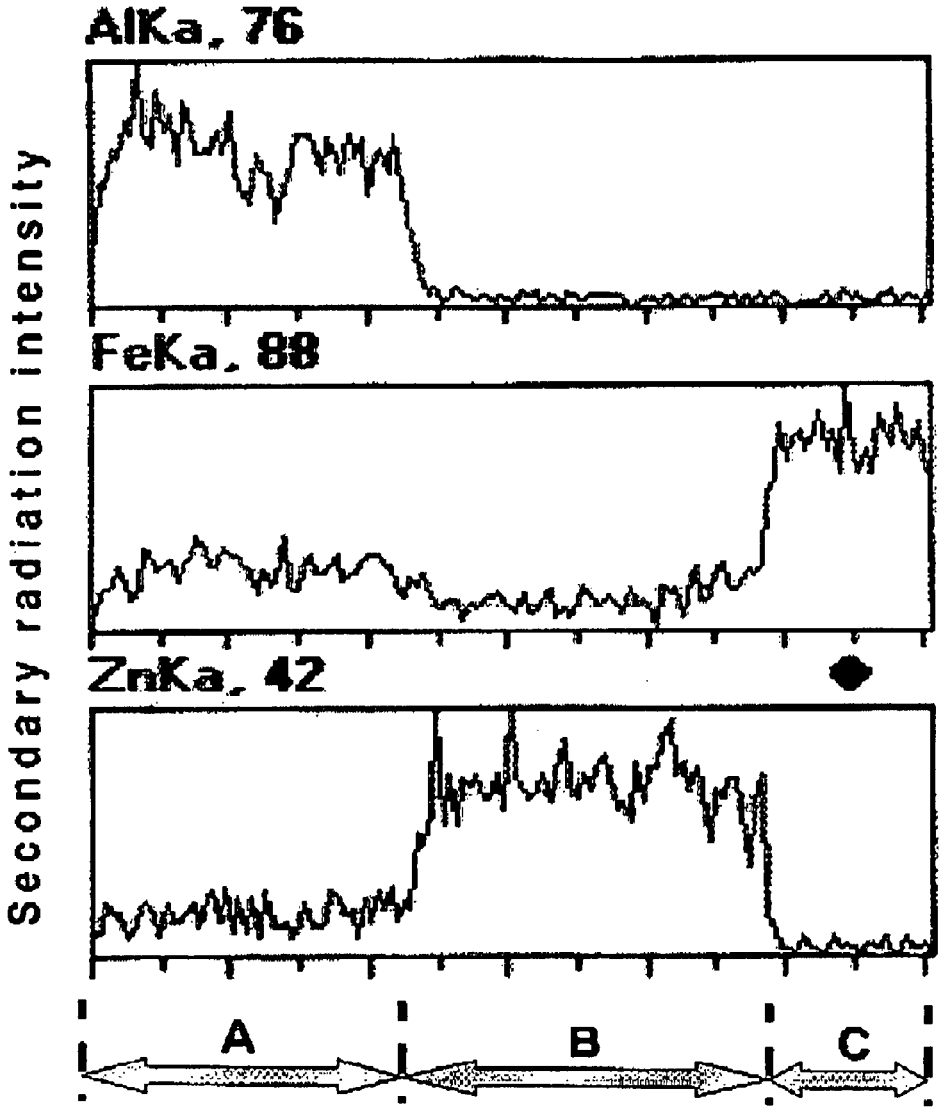
Fig. 4. Micro-analyze data of coating and inclusion chemical composition.
A Al rich inclusion; B – Zn diffusion layer; C – Fe-base substrate.

CORROSION RESISTANT POLY-METAL DIFFUSION COATINGS AND A METHOD OF APPLYING SAME

FIELD OF THE INVENTION

The present invention relates to coating compositions and more particularly, to the composition of and method of applying diffusion coatings on iron and iron-based item surfaces, of various shapes.

BACKGROUND OF THE INVENTION

The anticorrosive property requirements imposed on products and components are becoming ever more stringent. For example, ten years ago, an acceptable corrosion resistance level under salt spray tests for the most widely accepted and commercially used anticorrosive zinc coating was the 75-hour corrosion resistance level or, as a maximum, the 150-hour corrosion resistance level. Today, the requirement may be a 400-hour corrosion resistance level or greater. (The salt spray test data results cited herein were obtained using standard ASTM B 117).

Anticorrosive coating manufacturers have attempted to meet the more stringent coating corrosion resistance requirements by the addition of numerous components aimed at increasing the corrosion resistance of their coating compositions.

In the electroplating process, coatings composed of Zn—Fe, Zn—Ni, Zn—Co, Zn—Cd alloys were developed and produced. By using chromate passivation, it became possible to maintain coating corrosion resistance for 400 to 500 hours, before red corrosion traces appeared in the salt spray test. Red corrosion traces indicate the beginning of iron-based substrate corrosion.

However, the added complexity and sensitivity of the coating precipitation process and the resulting need for more precise production control led to a substantial increase in coating production costs. In addition, the addition of environmentally dangerous elements, such as Ni, Co, and Cd, in the coatings led to higher waste treatment expenditures.

Another commonly accepted method for applying a corrosion resistant zinc-based coating is the hot-dip (or galvanizing) process; in which treated parts are immersed in a molten zinc bath. This method is widely used for applying coatings onto large-sized products, and also for a continuous process of applying protective coatings on metal sheet and wire.

However, the hot-dip zinc coating, thus applied, exhibits a relatively low corrosion resistance, (a corrosion resistance of approximately 150 hours was maintained before the appearance of red corrosion in the salt spray test) and high white corrosion susceptibility. White corrosion refers to the corrosion products of zinc.

In the 1970s, hot-dip processes were modified to use a bath containing aluminum, as well as zinc. Coatings produced using these hot-dip processes have various commercial names, however, their chemical composition is essentially the same. The coating, known in Europe and the USA as Galfan, contains 4.7–5.2% by weight of aluminum. The Galvalum coating, commercially produced in the USA, contains approximately 55% by weight of aluminum.

Galfan coating is characterized by a 3 to 5-fold lower corrosive mass-loss rate than that of conventional hot-dip technology coatings, and also, by an increased period of time elapsed before the appearance of red corrosion of the base metal.

Although the introduction of relatively small amounts of aluminum (usually 4–7% by weight) is known to lead to an increased corrosion resistance of zinc coating, the electrochemical mechanism that leads to this effect is not apparent.

The higher resistance of Zn—Fe, Zn—Ni, Zn—Cd alloys in comparison with pure zinc can be attributed to their higher electrode potential, as the electrochemical potential of the second component of the alloy is higher than that of zinc, as shown in the table below:

TABLE 1

Electrochemical Potential of Alloy Components

| Element | Electrochemical potential, V |
|---|---|
| Zn | −0.763 |
| Fe | −0.037 |
| Ni | −0.250 |
| Cd | −0.403 |
| Al | −1.663 |
| Mg | −2.37 |

Conversely, in zinc alloys with aluminum and magnesium having electrochemical potentials equal to −1.663 V and −2.37 V, respectively, the situation is reverse. From the electrochemical point of view, zinc alloys with aluminum and/or magnesium should be less corrosion resistant.

According to J. Tanaka et al., "Effect of Mg and Si on the Microstructure and Corrosion Behavior on Zn—Al Hot Dip Coatings on Low Carbon Steel" (ISIJ international, Vol. 42 (2002), N1, pages 80–85), a Zn—Al coating with Mg and Si admixtures has a complicated phase composition caused by phase transformation processes at the transition from bath temperature to room temperature. In addition to a Zn—Fe intermetallide layer, adjacent to the base metal, phases of almost pure zinc, almost pure aluminum, and eutectic Zn—Al compositions, with approximately 5–6% by weight of Al, are also observed. According to these authors, almost pure aluminum does not corrode due to its self-passivation capability.

The increased corrosion stability of Galfan type coatings seems to be due to the fact that the eutectic aluminum, when subjected to corrosion, forms insoluble compounds, which fill coating defects, such as, pores and cracks. In essence, the activity of these insoluble compounds provides an effect of coating self-passivation similar to that observed in pure aluminum and its alloys.

The increase in the corrosion resistance of zinc-aluminum coatings, produced by hot-dip technology, has been achieved by making the chemical composition of the coating more complex. Adding magnesium and silicon to the coating composition made it possible to bring the corrosion resistance of such coatings up to the level of today's industrial anticorrosive coating requirements.

The modified hot-dip technology process, however, requires an extremely delicate multistage pretreatment of surfaces to be coated, fluxing, and in many cases, chromate passivation of finished coating as well. There are also problems in maintaining a constant melt composition in the bath, and, as a rule, the coating itself is applied in several steps.

To attain a high coating adhesion to the substrate, it is necessary to introduce various kinds of admixtures into the bath, including rare-earth elements. This increases 2 to 2.5-fold the cost of polymetallic coating in comparison with a conventional hot-dip coating.

Coatings applied, using this technology, on parts of complex shape fail to provide a uniform thickness.

This technology is inapplicable for parts having blind holes and internal thread.

It is difficult to automate the process of coating small-sized parts. Applying coatings onto small flat parts, for example, washers, presents a problem as well.

The hardness level of zinc-based coatings, applied by both the electroplating and hot-dip processes, is not high. It is 50–65 HV for zinc, zinc-aluminum and other zinc alloy coatings. A low hardness level leads to a rapid wear of coating in friction and erosion areas and, consequently, to the deterioration of corrosion stability.

Another common drawback of zinc-based coatings, applied by both the electroplating and hot-dip processes, is their low adhesion to secondary coatings. The secondary coatings are applied to increase the corrosion resistance, to attain the required appearance of the product, and to obtain the specified technical characteristics, for instance, to increase or decrease the friction coefficient. White corrosion of zinc, developed in the vicinity of pores and defects of the second coating, leads to the mechanical destruction of the second coating. As the corrosion process advances, its products displace the second coating, which exhibits blistering.

The above-mentioned process drawbacks are eliminated using diffusive metal coatings. According to this technology, a substrate to be coated is placed into a powdered metal medium and heated up to a temperature, at which diffusion of atoms occurs between the substrate metal and the powder on the substrate surface. A particular version of this method widely used in industry is Sherardizing.

According to the established understanding, Sherardizing is a process where parts are heated for several hours in a closed, usually rotating, container together with zinc powder at temperatures of 370–450° C. As a result of this process, two intermetallide Zn—Fe phases are formed on the substrate surface. The first phase is usually only several microns thick. It is adjacent to the base metal and contains approximately 20% by weight of iron. The second phase, which forms the main part of the coating thickness, contains less iron, usually up to 12% by weight of iron.

The process temperature approaches the zinc melting temperature (~419° C.) and sometimes exceeds it. To prevent the powder from fusing and/or sticking to the substrates, the zinc powder is diluted with inert filler, such as, sand, aluminum oxide, and so forth. Alternately, according to Soviet Union patent SU 1534091 to Galin et al, the surface of zinc powder particles may be treated by a special hydrothermal method, which creates a layer that prevents the zinc powder particles from fusing.

As a result of the Sherardizing process, a relatively rough and porous coating is formed, which adheres uniformly to the profile of the substrate. The coating also serves as an excellent substrate, upon which to apply a second coating. The Zn—Fe intermetallide hardness level is high, 280–400 HV, and therefore prevents rapid wear of coating in friction and erosion areas and, consequently, maintains corrosion stability.

The corrosion resistance of the intermetallic Zn—Fe, containing approximately 12% by weight of Fe, would be expected to exceed that of electrochemically applied Zn—Fe alloy coatings. The electrochemically applied Zn—Fe alloy coatings exhibit a salt spray test corrosion resistance of up to 120 hours (and as high as 300 hours, after chromate passivation) at a thickness of 5 microns.

The Sherardizing process applied coating thickness may reach tens of microns and even exceed 100 microns; consequently, it would be natural to expect unique anti-corrosive properties of this coating. However, this is not the case. In a moist atmosphere, a layer of white corrosion covers a newly applied coating, obtained by using the Sherardizing process, in just a few hours. This white corrosion is a result of contraction cracks reaching the base metal. These contraction cracks are formed in the coating during the cooling-down of coated products.

Galvanic couples are rapidly formed in a moist, natural environment, promoting intense corrosion of the coating. Consequently, at present, all substrates coated using the Sherardizing method are either phosphatized and/or covered with a second protecting layer, for example, Dacromet paints. Phosphatization of substrates leads to an increase in salt spray test corrosion resistance levels. Corrosion resistance levels of up to 150–250 hours until the appearance of white corrosion, and up to 400 hours and more when organic coatings are applied, have been obtained.

The corrosion resistance of such a coating cannot be appreciably improved, not even by coloring with metal oxides and compounds introduced into the coating by the method suggested by U.S. Pat. No. 6,171,359 B1 to Levinski et al. The maximum salt spray test corrosion resistance of the coating, obtained using the Levinski patent, was only 192 hours until the appearance of yellow corrosion. Yellow corrosion refers to corrosion observed in a coating containing Fe. These relatively low corrosion resistance levels are due to the fact that these metal oxides coloring techniques slow down, but fail to entirely eliminate white corrosion development in the main coating, as described previously.

The prior art does not describe improvements to the Sherardizing coating corrosion resistance by means of alloying the coating with different chemical elements. Probably, this is due to the fact that the structure of the Zn—Fe intermetallic, in contrast to alloys, has a limited capability of alloying with other chemical elements.

Therefore, it would be desirable to provide a diffusion coating that possesses the advantages of the Sherardizing process, but attains a high corrosion resistance, as well. In addition, it would be desirable to attain specific unique properties in this coating by including other metals, such as, tin, silicon, and magnesium, in the coating composition.

SUMMARY OF THE INVENTION

Accordingly, it is a principal object of the present invention to overcome the above-mentioned disadvantages and provide a diffusion coating that possesses the advantages of the Sherardizing coating, but attains a high corrosion resistance, as well.

Specifically, it is an object of the present invention is to provide a polymetallic Zn—Fe—Al diffusion coating for iron-based item surfaces. This coating exhibits a high corrosion resistance (at least a 700-hour corrosion resistance level in a standard salt spray test), a relatively high hardness level and good adhesion to secondary coatings.

A further object of the present invention is to provide the composition of the saturating powder mixture that is required to implement the diffusion coating process to produce the coating.

The polymetallic coating of the present invention has a multiphase structure. The first two layers adjacent to the metal substrate contain Zn—Fe intermetallics, as is common for regular Sherardizing. The total thickness of these layers can equal or even exceed 100 microns. The optimal thickness for each particular instance is selected depending on the requirements for that instance.

In contrast to Sherardizing, in the present invention the main Zn—Fe intermetallic diffusion layer contains Zn—Al—Fe inclusions (FIGS. 1, 2). The composition of the phases of these inclusions depends to a great extent on the cooling rate and the initial saturation powder composition. The components Zn, Al and Fe must always be present in these phases. Other metals may also be included.

According to the present invention, the saturating powder mixture contains from 5 to 50% by weight of aluminum, 0–15% by weight of magnesium and other elements, such as, tin and/or silicon, and the balance zinc. It is recommended that the initial size of powder grains should not exceed 150 micron, the optimum size being 75 microns or less.

The finishing treatment of the coated pieces processed usually involves two operations: cleaning the coated items from the remaining powder and phosphate passivation. Other additional finishing operations may be: polishing the coating surface, pigmenting, oiling, and applying surface organic and inorganic films.

In accordance with a preferred embodiment of the present invention, there is provided a diffusion poly-metallic anticorrosive diffusion zinc-iron-aluminum coating for iron and iron-based item surfaces:

the coating, being obtained by a diffusion process that is realized by heating of products at temperatures of 370–450° C. in a saturating powder mixture environment in a closed container, wherein the coating composition comprises aluminum, as well as iron and zinc, as alloys and intermetallics.

In the preferred embodiment, particles of those alloys and intermetallics are distributed as Al-rich inclusions, serving as sacrificial phases, mainly on the surface of the coating.

In addition, the coating composition comprises other metals' admixtures, including admixtures of at least one of tin, silicon, and magnesium.

According to another embodiment, the saturating powder environment used to provide the metallic anticorrosive coating contains, apart from zinc, 5–50% by weight of aluminum and 0–15% by weight of at least one of tin, silicon, and magnesium.

According to another embodiment, the saturating powder environment used to provide the metallic anticorrosive coating contains, apart from zinc, 5–50% by weight of aluminum and 0–15% by weight of a combination of tin, silicon, and magnesium.

According to another embodiment, the saturating powder environment used to provide the metallic anticorrosive coating contains, apart from zinc, 5–50% by weight of aluminum and 0–15% by weight of two elements selected from the group of tin, silicon, and magnesium.

Other features and advantages of the invention will become apparent from the figures and the description contained hereinbelow.

BRIEF DESCRIPTION OF THE DRAWINGS

For a better understanding of the invention, reference is made to the accompanying drawings, in which:

FIG. 1 shows Al—Fe—Zn inclusions on the coating surface;

FIG. 2 shows a cross sectional view of an Al—Fe—Zn inclusion;

FIG. 3 presents salt spray test results for different coating compositions and processes; and FIG. 4 presents microanalysis data for coating and inclusion composition.

DETAILED DESCRIPTION OF A PREFERRED EMBODIMENT

As described previously, the primary cause of corrosion in Sherardizing process coating products is the electrochemical reaction between the substrate (consisting mainly of iron) and the intermetallic Zn—Fe coating.

To minimize the corrosion producing effects of the electrochemical reaction between the substrate and the intermetallic Zn—Fe coating, the present invention introduces sacrificial phases. These protect Zn—Fe intermetallics from a direct electrochemical reaction with the substrate material. In the present invention, inclusions formed from Al—Fe intermetallics and Zn—Al alloys can serve as such sacrificial phases. Al—Fe intermetallics and Zn—Al alloys, being more chemically active than intermetallic Fe—Zn, are not as likely to experience self-passivation as is aluminum. In Zn—Al alloys and Al—Fe intermetallics, a continuous passivation film of aluminum hydroxides is not formed.

In addition, products of aluminum corrosion possess low solubility in water. They precipitate on coating defects (cracks, pores, etc.), fill them and thereby considerably slow down the corrosion rate. This effect of aluminum corrosion product filling does not disappear even after the sacrificed phase is consumed. Moreover, zinc corrosion products enhance this effect by precipitating on coating defects, and thus imparting the coating with higher corrosion resistance under salt spray conditions. This mechanism explains the higher resistance of the coating disclosed in the present imvention, as compared with the well-known Galfan type Zn—Al coating (FIG. 3). In the Galfan type Zn—Al coating, Zn—Al eutectics virtually permeate the entire coating thickness.

The coating formation mechanism, proposed in the present invention, can better be understood by referring to standard phase diagrams (Binary Alloy Phase Diagrams, ASM Int., Second Edition, Editor-in-Chief T. B. Massalski). These phase diagrams accurately represent the diffusion process, since the diffusion process is relatively lengthy (up to 1.5–2 hours), and the particles of the phases formed are small in size.

The processes taking place may be presented in a Zn—Al phase diagram (Binary Alloy Phase Diagram). These processes take place at a temperature of 400° C., and in which the saturating mixture contains 85% by weight of Zn and 15% by weight of Al. In the course of heating, zinc and aluminum interdiffuse between powder particles in the saturating mixture, and as a result form powder grains containing approximately 92% by weight of Zn and 8% by weight of Al, as well as powder grains containing approximately 82% by weight of Zn and 18% by weight of Al.

During the coating process, zinc diffuses from the saturating powder environment and forms the layer of Zn—Fe intermetallics on the surface of the substrates. The powder mixture becomes enriched with aluminum. The reaction of aluminum with iron begins and Fe—Al intermetallics are formatted. This reaction occurs due to diffusion of iron from the Zn—Fe intermetallic layer into the Zn—Al pore powder grains. These inclusions are randomly distributed, for the most part on the Zn—Fe intermetallic surface, as Al—Fe intermetallics. (FIG. 1).

This multiphase coating formation mechanism demands specific conditions to provide optimal properties:

1. The Zn quantity contained in the saturating powder mixture, which is added into the container for the coating process, should not significantly exceed the amount necessary to produce an intermetallide Zn—Fe layer of a specified thickness.
2. To optimize coating formation, the particles of the saturating environment should constantly be on the surface of the treated substrates. This is achieved by constantly supplying powder particles to the substrate's surface. One way to accomplish this task is to conduct the process in a rotating container with wall-mounted mixing blades.
3. To avoid macro-inhomogeneity of the coating composition, which tends to cause a deterioration in the corrosion resistance of the coating, it is necessary to exclude the use of inert filler and apply other methods of powder protection from sintering, for example, hydrothermal powder treatment, such as is described in Soviet Union Pat. No. SU 1534091.

Described below is an example of a detailed procedure, including detailed lists of reagents and equipment, used to prepare coatings, in accordance with the principles of the present invention.

The following materials for saturation and reagents for admixtures were used:

1. Zinc powder, supplied by Numinor Chemical Industries Ltd. (Israel), contained 93–96% of zinc metal, with the following particle size: Less than 110 microns=100% of the particles.
2. Aluminum powder, supplied by Zika Electrode Works Ltd. (Israel), contained 98.5% of aluminum metal, with the following particle size distribution: 105–75 microns=5% of the particles; 75–62 microns=15% of the particles; Less than 44 microns=30% of the particles.
3. Zinc oxide, supplied by Numinor Chemical Industries Ltd. (Israel), was pigment grade.
4. Magnesium powder, supplied by Zika Electrode Works Ltd. (Israel), contained 99.8% of magnesium metal, with the following particle size distribution: 420–297 microns=2% of the particles; Less than 150 microns=97% of the particles. The fraction of the particles greater than 75 microns, which was used later in the work, was isolated from this powder.
5. Silicon powder, supplied by Riedel-de Haen (Germany), contained 99% of silicon metal with the following particle size distribution: Greater than 75 microns=0% of the particles; 75–62 microns=34% of the particles; Less than 44 microns=66% of the particles.
6. Nickel powder (ME-040 grade), supplied by Zika Electrode Works Ltd. (Israel), contained 99.5% of nickel metal.
7. Tin powder, supplied by Amdikat Ltd. (Israel), contained 99.88% of tin metal with the following particle size distribution: 100–44 microns=5.8% of the particles; Less than 44 microns=94.2% of the particles.
8. Orthophosphoric acid solution, supplied by H.M. Chimilab Ltd. (Israel), contained 85% of the original orthophosphoric acid.

Original metal powders were subjected to hydrothermal treatment in compliance with Soviet Union patent SU 1534091. Powders and water in the amount of 0.5–1% by weight were kept for one hour in a sealed reactor heated up to 300–350° C.

The process of diffusion saturation was carried out at the same temperature of 400° C. (unless indicated otherwise) and the same dwell time (60 minutes) for all saturating mixture compositions. These parameters are typical of the regular Sherardizing process.

The coating process itself, in the present invention, was performed as follows.

250 g of 1010 steel plates size (20×34×2 mm) were placed into a cylindrical container (165 mm diameter and 120 mm long). The cylindrical container had fixed blades mounted on the inside wall for mixing powder and substrate. The container was filled up with a calculated amount of saturating mixture.

The quantity of zinc introduced with this mixture remained constant and amounted to 10 g.

The container was tightly sealed with an end cover and placed into a furnace equipped with a container-rotating device. The experiments have shown that at a rotation rate exceeding 0.5 rpm, the saturation rate is independent of the rotation rate. The increase of rotation rate can result in deforming the substrate under treatment. Consequently, the rotation rate was set at 0.8 rpm.

When the coating process was completed, the container was cooled down, and the dust remaining on the substrates was washed off using water.

The substrates were dried and passivated for 10 minutes at a temperature of 30–40° C. The passivation solution contained 30 g/l of ZnO and 84 ml/l of orthophosphoric acid.

Weighing was accomplished using an A&D analytical balance, model HF-300G.

The coating thickness was determined using an Electromatic Equipment Co. magnetic thickness gauge, model DCF-900. On polished sections a Nikon microscope, model Optihot-100S was used.

Hardness was measured using a Buehler microhardness tester, Micromet 2100.

Chemical composition of coatings was determined by the XRF local microanalysis method using the JEOL-6400 instrument.

The corrosion resistance of the coating was determined in compliance with standard ASTM B117 using the salt spray test. The quantitative measure of resistance is defined as the time elapsed before the appearance of white corrosion over the entire surface and red corrosion on 5% of the specimen surface.

The mass loss in the salt spray test process was determined by weighing a specimen before and after testing, the corrosion products having removed from the specimen surface.

Experimental test results are given in the table below:

TABLE 2

| Test No. | Al content of mixture, weight % | Other impurities and their content, weight % | Experimental test results: Isothermal aging temp., ° C. | Coating thickness, microns | Corrosion resistance, hours: White corrosion | Red corrosion | Hardness, HRC |
|---|---|---|---|---|---|---|---|
| 1 | 0 | 0 | 400 | 35 ± 5 | 168 | 168 | 31 ± 3 |
| 2 | 3 | 0 | 400 | 34 ± 4 | 220 | 220 | 34 ± 3 |
| 3 | 10 | 0 | 400 | 35 ± 5 | 336 | 384 | 36 ± 3 |
| 4 | 15 | 0 | 400 | 33 ± 4 | no created | 720 | 36 ± 3 |
| 5 | 20 | 0 | 400 | 32 ± 4 | no created | 768 | 36 ± 3 |
| 6 | 30 | 0 | 400 | 31 ± 4 | no created | 792 | 36 ± 3 |
| 7 | 50 | 0 | 400 | 30 ± 4 | no created | 792 | 36 ± 3 |
| 8 | 15 | 0 | 420 | 38 ± 4 | no created | 744 | 36 ± 3 |
| 9 | 15 | 0 | 450 | 40 ± 4 | no created | 720 | 36 ± 3 |
| 10 | 15 | 0 | 385 | 27 ± 4 | no created | 720 | 35 ± 3 |
| 11 | 15 | 0 | 370 | 14 ± 4 | 120 | 120 | 35 ± 3 |
| 12 | 15 | Mg; 5 | 400 | 33 ± 4 | no created | 768 | 36 ± 3 |
| 13 | 15 | Mg; 15 | 400 | 32 ± 4 | no created | 792 | 38 ± 3 |
| 14 | 5 | Mg; 25 | 400 | 33 ± 4 | no created | 816 | 36 ± 3 |
| 15 | 0 | Mg; 3 | 400 | 33 ± 4 | no created | 384 | 35 ± 3 |
| 16 | 0 | Mg; 20 | 400 | 33 ± 4 | no created | 864 | 35 ± 3 |
| 17 | 0 | Mg; 30 | 400 | 34 ± 4 | no created | 864 | 35 ± 3 |
| 18 | 0 | Si; 15 | 400 | 35 ± 4 | 148 | 148 | 36 ± 3 |
| 19 | 15 | Si; 15 | 400 | 35 ± 4 | no created | 696 | 41 ± 3 |
| 20 | 0 | Sn; 15 | 400 | 35 ± 4 | 96 | 96 | 30 ± 3 |
| 21 | 20 | Sn; 15** | 400 | 35 ± 4 | 168 | 168 | 30 ± 3 |

Notes:
*The coating is lighter than at conventional Sherardizing.
**The coating features good solderability.

As follows from the data presented in Table 2, adding aluminum into the saturating mixture in the amount of more than 3% by weight increases substantially the coating corrosion resistance. The higher the aluminum content of the mixture, the greater the coating corrosion resistance increase. This is true up to 30–50% by weight of aluminum. At the same time, the addition of metals electrochemically more passive than zinc, not only produces no increase in the coating corrosion resistance, but even reduces it. Test No. 18, with tin used as an additive, is most indicative. Due to a low melting temperature (~232° C.), tin actively interacts with zinc at the saturation temperature. When the products of this interaction get into the coating, they stimulate the electrochemical corrosion of Zn—Fe coating.

However, the introduction of relatively small quantities of other elements along with Al imparts other important technological properties to the coating. Thus, for example, the introduction of tin (Test No. 18) improves the solderability; and the introduction of silicon (Test No. 16) increases the coating hardness.

FIG. 2 shows a coating metallographic cross section picture of the sample coated in Test No. 8. The inclusions, having different structure than the main coating structure, are clearly shown. The average size of these inclusions is 46 microns. According to microanalysis data, the composition of these inclusions is as follows: 30% by weight of zinc, 39% by weight of iron and 30% by weight of aluminum. According to the Fe—Al binary phase diagram, the included particles are comprised of Fe—Al intermetalic and Zn—Al alloy. Apparently, the presence of patches, having such a composition, results in a higher coating corrosion resistance, according to the mechanism discussed earlier.

FIG. 3, showing mass losses of various coatings at salt spray test, provides an illustration of the high corrosion resistance of the proposed coating.

Specimens with coatings produced with the addition of aluminum (Test No. 8), and aluminum and magnesium (Test No. 13) to the saturating mixture were prepared to check the possibility of using them as a substrate for applying a varnish-and-paint coating. KTL e-coating, applied by the electrophoresis method, was used as the latter coating. The coating thickness was 7–10 microns. Adhesion tests, by scratching, demonstrated the total absence of organic coating breakdowns. Standard salt spray corrosion tests of these specimens were stopped after 1200 hours of tests, in which no traces of corrosion were detected.

Having described the invention with regard to certain specific methods and compositions, it is to be understood that the description is not meant as a limitation, since further modifications may now suggest themselves to those skilled in the art, and it is intended to cover such modifications as fall within the appended claims. For instance, not only Al and Mg powders, but also powders of their alloys with one another or with other metals can be used as additives.

I claim:

1. A diffusion multiphase metallic anticorrosive coating comprising a Zn—Fe diffusion intermetallic layer applied on iron and iron-based item surfaces, said coating comprising discrete, laterally non-continuous aluminum rich inclusions randomly distributed mainly on the surface of said layer, said inclusions serving as sacrificial phases forming corrosion products during exposure, said corrosion products significantly reducing the corrosion rate of said Zn—Fe diffusion intermetallic layer, thereby providing a relatively high corrosion resistance.

2. The coating according to claim 1, wherein the coating composition further comprises admixtures of at least one of tin, silicon, and magnesium.

3. The coating according to claim 1, wherein the coating composition further comprises admixtures of a combination of tin, silicon, and magnesium.

4. The coating according to claim 1, wherein the coating composition further comprises admixtures of two elements selected from the group of tin, silicon, and magnesium.

5. A diffusion metallic anticorrosive zinc-iron-aluminum coating comprising a Zn—Fe diffusion intermetallic layer applied on surfaces of iron and iron-based items, said anticorrosive coating being obtained by a diffusion process, realized by heating of said iron and iron-based items at temperatures of 370–450° C. in a saturating Zn—Al powder environment in a closed container, said coating comprising discrete, laterally non-continuous aluminum rich inclusions randomly distributed mainly on the surface of said layer, said inclusions serving as sacrificial phases forming corrosion products during exposure, said corrosion products significantly reducing the corrosion rate of said Zn—Fe diffusion intermetallic layer, thereby providing a relatively high corrosion resistance.

6. The coating according to claim 5, wherein the coating composition further comprises admixtures of at least one of tin, silicon, and magnesium.

7. The coating according to claim 5, wherein the coating composition further comprises admixtures of a combination of tin, silicon, and magnesium.

8. The coating according to claim 5, wherein the coating composition further comprises admixtures of two elements selected from the group of tin, silicon, and magnesium.

9. A method of applying the metallic anticorrosive coating according claim 5 to an iron and iron-based surface, wherein the Al in the saturating powder environment ranges between 5–50% by weight.

10. A method of applying the metallic anticorrosive coating according to claim 6 to an iron and iron-based surface, wherein the saturating powder environment contains, 0–15% by weight of at least one of tin, silicon, and magnesium.

11. A method of applying the metallic anticorrosive coating according to claim 7 to an iron and iron-based starface, wherein the saturating powder environment contains, 0–15% by weight of a combination of tin, silicon, and magnesium.

12. A method of applying the metallic anticorrosive coating according to claim 8 to an iron and iron-based surface, wherein the saturating powder environment contains, 0–15% by weight of two elements selected from the group of tin, silicon, and magnesium.

13. A multiphase metallic ariticorrosive coating on an iron or iron-based substrate, said substrate coated with a Zn—Fe diffusion layer having an upper surface, said multiphase metallic anticorrosive coating comprising discrete, laterally non-continuous Zn—Al—Fe inclusions on said upper surface of said Zn—Fe diffusion layer, said Zn—Al—Fe inclusions sufficient to siqnificantly reduce the corrosion rate of said Zn—Fe diffusion intermetallic layer in a standard neutral salt spray test and in a real environment.

14. The multiphase metallic anticorrosive coating of claim 13, wherein said discrete Zn—Al—Fe inclusions are randomly distributed on said upper surface.

15. The multiphase metallic anticorrosive coating of claim 13, wherein said corrosion rate, during 700 hours of said standard neutral salt spray test, is equivalent to a coating loss of approximately one-fifth the coating loss for zinc-aluminum hot-dip galvanizing coating (Galfan), wherein said standard neutral salt spray test is in accordance with ASTM B117, or equivalent specification.

* * * * *